US008726624B2

(12) United States Patent
Stephan et al.

(10) Patent No.: US 8,726,624 B2
(45) Date of Patent: May 20, 2014

(54) METHOD AND DEVICE FOR YARN BRAKING ESPECIALLY AT RENEWAL OF SPINNING IN A WORKING POSITION OF AN AIR JET SPINNING MACHINE

(71) Applicant: Maschinenfabrik Rieter AG, Winterthur (CH)

(72) Inventors: Adalbert Stephan, Beilngries (DE); Marek Burysek, Usti nad Orlici (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 13/687,427

(22) Filed: Nov. 28, 2012

(65) Prior Publication Data

US 2013/0227925 A1 Sep. 5, 2013

(30) Foreign Application Priority Data

Nov. 28, 2011 (CZ) ..... PV 2011-772

(51) Int. Cl.
*D01H 13/00* (2006.01)

(52) U.S. Cl.
USPC ..... 57/78

(58) Field of Classification Search
USPC ..... 57/78, 87; 242/149, 152.1, 410
See application file for complete search history.

(56) References Cited

U.S. PATENT DOCUMENTS 4,280,321 A * 7/1981 Marzoli ..... 57/81
4,777,790 A 10/1988 Raasch
5,050,816 A 9/1991 Niederer
5,368,244 A * 11/1994 Melillo et al. ..... 242/149

FOREIGN PATENT DOCUMENTS

CZ 2007-629 3/2009

OTHER PUBLICATIONS

English Abstract and Publication—JP1481912 cited in CZ Search Report, Feb. 27, 1989.
Search Report, Industrial Property Office of the Czech Republic, Apr. 26, 2012.
EP Search Report, Mar. 18, 2013.

* cited by examiner

*Primary Examiner* — Shaun R Hurley
(74) *Attorney, Agent, or Firm* — Dority & Manning, P.A.

(57) ABSTRACT

The method and corresponding device of yarn braking are provided by means of an attending device provided with a vacuum tube into which the end of the yarn is sucked in before commencement of braking. At drawing off from the vacuum tube, the yarn is braked between the braking surfaces of a stationary brake friction member and a moving brake friction member, which are arranged on the attending device displaceably to the track of the yarn. For generating the braking force, the moving brake friction member moves towards the stationary brake friction member and fits against it at a contact abscissa or a contact surface.

15 Claims, 3 Drawing Sheets

METHOD AND DEVICE FOR YARN BRAKING ESPECIALLY AT RENEWAL OF SPINNING IN A WORKING POSITION OF AN AIR JET SPINNING MACHINE

TECHNICAL FIELD

The invention relates to a method of yarn braking especially at renewal of spinning in a working position of an air jet spinning machine by means of attending a device provided with a vacuum tube into which, before commencement of braking, there is the end of the yarn sucked in. At drawing off from the vacuum tube, the end of the yarn is braked between the braking surfaces of a stationary brake friction member and moving brake friction member, which are arranged on the attending device displaceably to the path of the yarn. For generating the braking force, the moving brake friction member moves towards the stationary brake friction member and fits against it at a contact abscissa or a contact surface.

The invention also relates to a device for braking of the yarn especially at renewal of spinning in a working position of an air jet spinning machine by means of attending a device arranged displaceably along a line of working positions of the machine. The attending device is provided with a vacuum tube for sucking-in and subsequent releasing of the end of the yarn for spinning-in, whereas to the mouth of the vacuum tube there are assigned the stationary brake friction member and the moving brake friction member. The stationary brake friction member includes a braking surface arranged across a motion of the yarn, and the moving brake friction member is formed by a plate arranged under the stationary member in a moving manner between its released and braking position. The moving brake friction member abuts towards the braking surface of the stationary brake friction member at the contact abscissa or the contact surface.

BACKGROUND

Spinning renewal in a working position of an air jet spinning machine occurs after a yarn break or spooling full length of a yarn on a reel. Start of spooling on an empty tube and spinning renewal is performed by an attending device that is arranged displaceably along the working positions of the machine. After stopping at the attended working position, the attending device finds the end of the yarn on the reel or the end of the auxiliary yarn and inserts it into the spinning jet, which is the end of the yarn drawn through, and the yarn of adequate beforehand set length is sucked-in into the vacuum tube. Then the spinning-in begins and new fibres of the spun-out yarn are joined with the end of the yarn drawn off from the vacuum tube inside the spinning jet. It is necessary to brake the yarn being drawn off from the vacuum tube to achieve a quality spin-in.

CZ 2007-629 A3 describes a method and a device for yarn braking, where the device is arranged in proximity to the mouth of the vacuum tube on the attending device of the spinning machine. The yarn is temporarily stored in the vacuum tube, from which it is drawn off afterwards. According to the described method, after moving to the attended operation unit, before commencement of braking, the yarn is inserted to a braking area between two brake friction members, one of which is out of the area at that time. After insertion of the yarn to the braking area, the brake friction members moves closer to the yarn and to each other to such distance, where they act on each other by magnetic force caused by a magnet placed on at least one of them. By the effect of the magnetic force, the brake friction members pull to each other and clamp the yarn with the set force, which causes braking of the yarn.

The device according to CZ 2007-629 A3 comprises two brake friction members, at least one of which is movable to the braking area from a rest position located out of the braking area. Further, at least one of the brake friction members is equipped with a magnet and the other is made of magnetic material. The advantage of the device lies in the fact that there is a good access of the yarn to the braking area and simple induction of the braking force by means of the magnetic force acting between brake friction members.

The disadvantage of both the method and the device according to CZ 2007-629 A3 lies in the fact that the braking force is constant for one yarn diameter and it is difficult to change when, in case it is needed technologically, yarn diameter changes. Regulation is performed by mechanical adjustment of the magnet for a change of the braking force.

The goal of the invention is to simplify mutual coupling of brake friction members and to facilitate changing of setting of the device's braking effect to the yarn.

SUMMARY OF THE INVENTION

Objects and advantages of the invention are set forth in part in the following description, or may be obvious from the description, or may be learned through practice of the invention.

A goal of the invention is achieved by the method of yarn braking, the principle of which consists in the fact that to generate the braking force on a moving brake friction member an action force in a loading point and reaction force in a stop point is generated. One of these points is found at the end of the moving brake friction member lying opposite to a contact abscissa or the contact surface and the second is lying between this member and the contact abscissa or the contact surface. The action force is generated by means of a control member and the reaction force is generated by means of the stop, against which the moving brake friction member leans, so that the braking surface of the moving brake friction member always abuts against the braking surface of the stationary brake friction member along the whole length of their contact abscissa or contact surface.

The method ensures parallelism of braking surfaces of the brake friction members during braking and mutual abutment along the whole length of their contact abscissa or the contact surface and enables regulation of braking force by the change of force applied in the loading point.

So, two arrangements of the loading point and the stop point are possible. According the first arrangement, the loading point lies between the contact abscissa or the contact surface and the stop point. According to the second one, the stop point lies between the contact abscissa or contact surface and the loading point. Considering the device design, the first option seems to be more advantageous.

For securing fast and accurate abutment of the braking surface of the moving brake friction member on the braking surface of the stationary brake friction member along the whole length of their contact abscissa or contact surface, it is advantageous if the connecting line of the loading point and the stop point divides the contact abscissa/surface into halves.

For enabling easy sucking-in of the yarn to the vacuum tube, it is advantageous if both brake friction members in the position when they are not subject to braking are to be found outside the space for braking, into which they transfer before commencement of braking.

The control member can be represented by any suitable device, while a pneumatic cylinder seems to be optimal, particularly for easy regulation of action force by the change of air pressure in a control circuit of the pneumatic cylinder.

The principle of the device according to the invention consists in the fact that the control member and the stop are assigned to the moving brake friction member. One of them abuts against the end of the moving brake friction member opposite to the contact abscissa contact surface to one side of the moving brake friction member, and the second abuts between the mentioned end and the contact abscissa or the contact surface to the opposite side of the moving brake friction member.

Besides perfect mutual abutment of the brake friction members at the contact abscissa or surface, the advantage of the device lies particularly in easy regulation of the braking force generated by means of the control member.

Considering the device design, it is advantageous if the control member abuts against the moving brake friction member between the contact abscissa or contact surface from the side being opposite to the braking surface, because this space is not limited by the vacuum tube, which is arranged above a side of the moving brake member containing a braking surface. The stop is arranged at the end being opposite to the contact abscissa/surface and it abuts from the side of the braking surface.

However, the reversed arrangement is also possible, where the control member abuts against the moving brake friction member at the end being opposite to the contact abscissa or contact surface from the side of the braking surface. For this arrangement, the stop abuts between the mentioned end and the contact abscissa or contact surface to the opposite side of the moving brake friction member.

With an advantageous embodiment of the device, the control member is formed by the pneumatic cylinder, which can be single or double-acting.

For regulation of the braking force, it is advantageous if the pneumatic cylinder is equipped with a pressure regulator.

For precise and reliable functionality, it is advantageous if, in the place of abutment of the control member against the moving brake friction member and/or in the place of abutment of the stop against the moving brake friction member, there is at least one of a couple of the contact surfaces represented by a spherical surface. The spherical surface can be made on the control member and/or on the moving brake friction member and/or on the stop. It enables easy swinging of the moving brake friction member while abutting on the brake friction surface of the stationary brake friction member in case of need.

For easy wrapping of the braked yarn, the stationary brake friction member is formed by a cylinder, against which the moving brake friction member abuts upon braking at the contact abscissa.

For increasing the braking effect, the brake friction member comprises a plane braking surface, against which the moving brake friction member abuts upon braking at the contact surface.

DESCRIPTION OF THE DRAWINGS

Embodiments of the device according to the invention are represented in the drawings, where.

DETAILED DESCRIPTION

Figure 1:
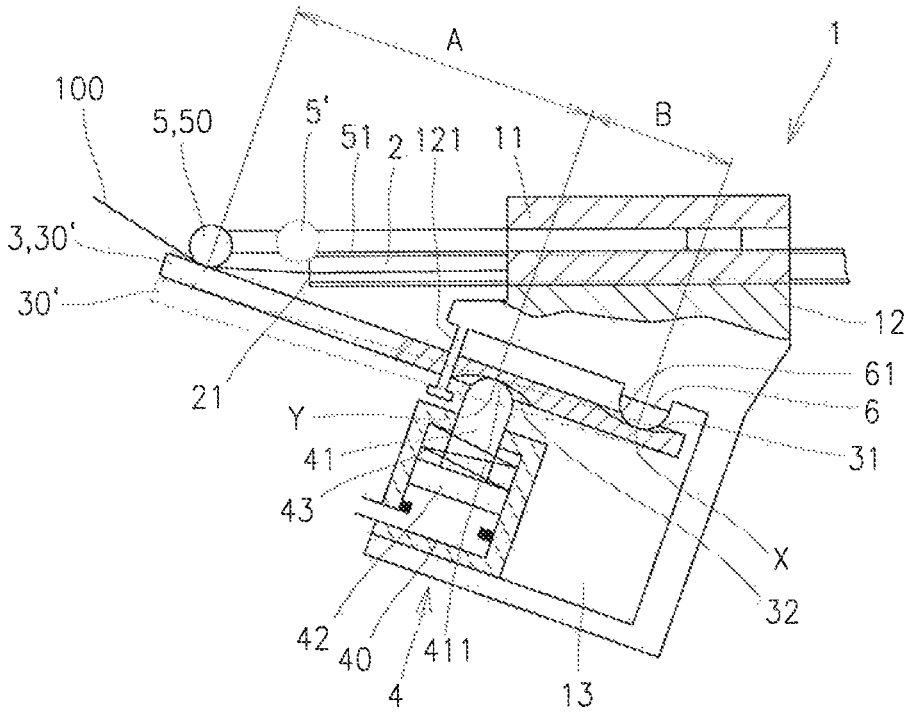
FIG. 1 represents the side view of the device with the partial section.

Reference is now made to particular embodiments of the invention, one or more examples of which are illustrated in the drawings. Each embodiment is provided by way of explanation of the invention, and not as a limitation of the invention. For example, features illustrated as described as part of one embodiment may be used with another embodiment to yield still a further embodiment. It is intended that the present invention include these and other modifications and variations.

Figure 2:
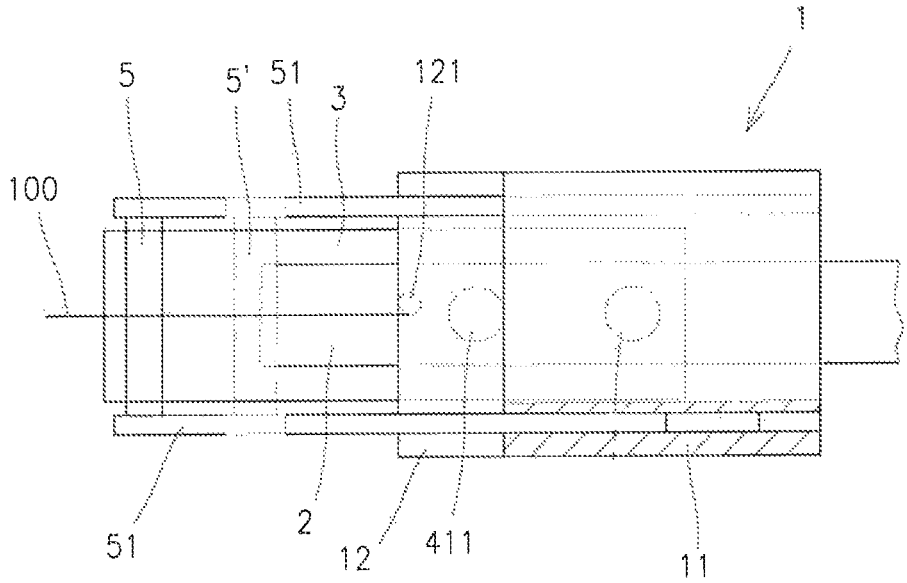
FIG. 2 represents the plan view of the device with the partial section.

With the embodiment represented in FIGS. 1 and 2, the device for braking of the yarn is arranged on the attending device of the jet spinning machine, which is arranged displaceably along a line of work positions of the machine and provided with a vacuum tube 2 for sucking-in and subsequent releasing of the end of the yarn 100 for spinning-in. In the attending device of the FIGS. 1 and 2, there is shown a brake body j which is in the represented embodiment divided to the upper part 11 and bottom part 12 and between them the vacuum tube 2 is placed. The mouth 21 of the vacuum tube 2 projects beyond the front part of the brake body 1. Above the mouth 21 of the vacuum tube 2 there is arranged the stationary brake friction member 5, which is placed on the couple of the guiding bars 51, which are placed slidingly in the upper part 11 of the brake body 1 and coupled with a known (not depicted) drive, e.g. a pneumatic cylinder. The guiding bars 51 can be replaced by a single guiding bar of proper shape and strength. For the represented embodiment, the stationary brake friction member 5 is formed by a cylinder, which is placed between the guiding bars 51 across the trace of the yarn 100. The part of the stationary brake friction member 5, which is wrapped by the yarn 100 during drawing off of the yarn 100, forms the yarn braking surface.

Below the mouth 21 of the vacuum tube 2 there is designed the bottom part 12 of the brake body 1, in which, under the stationary brake friction member 5, the moving brake friction member 30 is arranged. The moving brake friction member 30 is formed by the plate 3, in the central part of which there is formed an opening through which a pintle 121 freely runs. The pintle 121 is fixed in the bottom part 12 of the brake body 1 and, at the loose end, it is fitted with a widening against which the plate 3 leans at its released position, where its front end designated for braking is maximally distanced from the stationary brake friction member 5. The upper side of the plate 3 forms the braking surface 31 in its front part. To the plate 3 of the moving brake friction member 30 the control member 4 and the stop 6 are assigned. In a not depicted embodiment, the pintle 121 can be replaced by a couple of pintles.

With the depicted embodiments, the stop 6 is placed in the brake body 1, above the upper side of the plate 3, which abuts against the stop 6 in the area of its rear end. The control member 4 is placed in the brake body 1, under the bottom side of the plate 3 and, with the depicted embodiment, is formed by a pneumatic cylinder 40, a piston rod 41 that abuts, during the braking, on the bottom part of the plate 3 between its front part and the place of abutment of the stop 6. So, the piston rod 41 represents an action member of the control member 4. During the braking, the plate 3, which forms the moving braking member 30, abuts by its front part on the stationary brake friction member's 5 braking surface, which is formed by the cylinder, and the place of their contact is represented by the contact abscissa 301. For abutment, the stop 6 is fitted with the spherical surface 61 on its top and the plate 3 abuts on the apex of this spherical surface in the stop point X. The piston rod 41 of the pneumatic cylinder 40 is fitted with the spherical surface 411 on its top and it abuts on the plate 3 in the loading point Y by the apex of this spherical surface.

Figure 6:
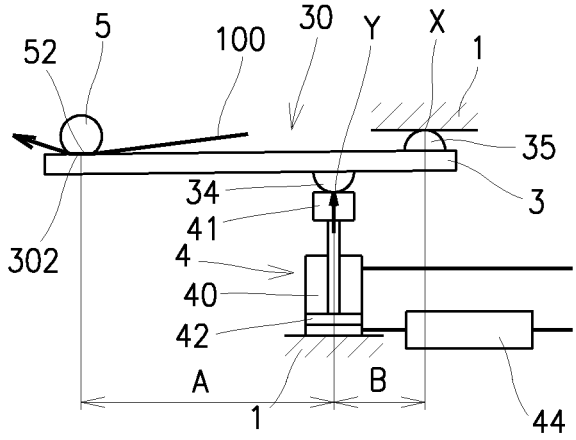
FIG. 6 represents the diagram of the device with the spherical abutment surfaces on the moving brake friction member.

With the embodiment according to the FIG. 6, in the points of abutments X, Y of the stop 6 and the piston rod 41 on the plate 3 of the brake friction member 30, there are designed protrusions, one of which is oriented against the control member 4 and the second is oriented against the stop 6. Tops of the protrusions are fitted with the spherical surfaces 34, 35. The protrusion on the bottom side of the plate is fitted with the spherical surface 34 oriented against the control member 4 which is, defined by a plane surface, and the protrusion on the upper side of the plate 3 is fitted with the spherical surface 35 oriented against the stop 6 which is defined by a plane surface. The tops of the control member 4 and the stop 6 can be also formed by spherical surfaces, so two spherical surfaces abut against each other in the points X and Y. According to demands, shapes of mutual abutting surfaces of the plate 3 and the piston rod 41 and/or the plate and the stop 6 are possible to be variously combined and suitably shaped in a way different from the described way.

With the embodiment depicted in the FIGS. 1 and 2, at the loading point Y in the plate 3, there is formed the spherical hollow 32 and at the stop point X in the plate 3, there is formed the spherical hollow 33.

Figure 5:
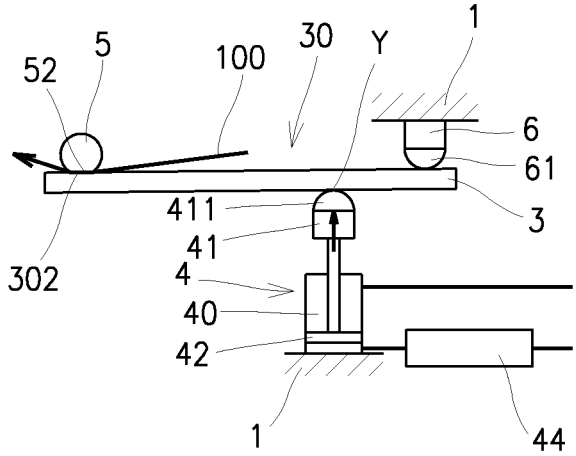
FIG. 5 represents the diagram of the device in the front view, where the stationary brake friction member comprises the plane braking surface.

With the embodiment according the FIG. 5, on the cylinder of the stationary brake friction member 5, the plane braking surface 52 is formed. It serves for the abutment of the moving brake friction member 30, which abuts against the stationary brake friction member 5 at the contact surface 302.

Figure 4:
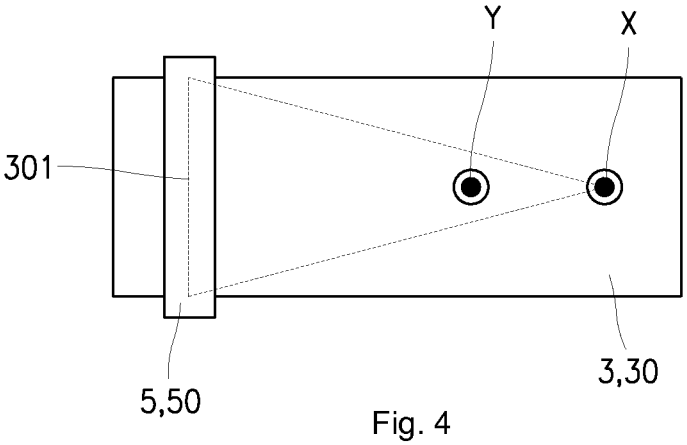
FIG. 4 represents the diagram of the device in the plan view.

Considering the design of the device and the generation of the braking force along the full length of the contact abscissa 301 (FIG. 4) or the contact surface 302, it is advantageous if both the control member 4 and the stop 6 abut on the plate 3 of the moving brake friction member 30 at its longitudinal axis, so their effect is the most precise and the connecting line of the loading point Y and the stop point X divides the contact abscissa 301 or the contact surface 302 into halves, as in FIG. 4.

At the embodiment according the FIGS. 1 and 2, the control member 4 is represented by the single-acting pneumatic cylinder 40, the piston 42 of which is returned to the base released position by the return spring 43. The control member 4, together with the end of the plate 3 on which it acts, the stop 6, and the pintle 121, is placed in the chamber 13 which is designed in the bottom part 12 of the brake body 1 and opened forwards.

Figure 3:
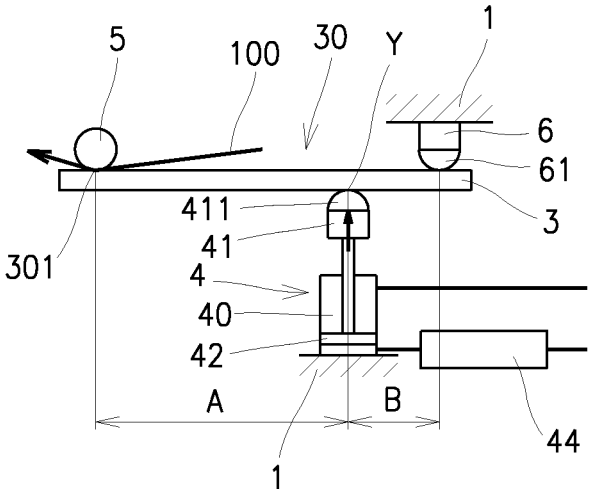
FIG. 3 represents the diagram of the device in the front view.

With the embodiment according the FIGS. 3 through 5, the control member 4 is represented by the double-acting pneumatic cylinder 40, in the control circuit of which, the air pressure regulation member 44 is integrated in the branch conveying pressure air for braking. It serves for changing of pressure force of the moving brake friction member 30.

The above described positions of the control member 4 and the stop 6 can be interchanged in case of demand for different construction of the device. Then, the control member 4 abuts on the moving brake friction member 30 at its end being opposite to the contact abscissa 301 or the contact surface 302, from the upper side, thus the side of the braking surface 31. The stop 6 abuts against the moving brake friction member 30 from the other side, between the contact abscissa 301 or the contact surface 302 and the control member 4. In the same manner, the stop point X and the loading point Y are interchanged, so the stop point lies between the contact abscissa 301 or the contact surface 302 and the loading point Y.

Before commencement of braking, both brake friction members 30, 5 are in released position out of the braking area. The released position of the brake friction members 30, 5 is in FIGS. 1 and 2 represented by the dashed line and marked as 30' and 5'. The guiding bars 51 are tucked in the brake body 1. The plate 3 of the moving brake friction member 30 is, in its released position, hung on the pintle 121 and leans against the stop 6 with its rear end. In the case where the centre of gravity of the plate 3 does not lie between the pintle 121 and the front end of the plate 3, the plate 3 does not lean against the stop 6. After the length of the yarn 100 necessary for spinning-in is sucked-in, before commencement of drawing-off of the yarn 100 from the vacuum tube 2, the guiding bars 51 pull the stationary brake friction member 5 out to its braking position, in which the stationary brake friction member 5 gets in contact with the yarn 100, and then it does not move throughout the braking duration. After that, the moving brake friction member 30 is put in action. With the depicted embodiments, this is done by means of letting pressure air in under the piston 42 of the pneumatic cylinder 40. As a result, the piston 42 shifts, together with the piston rod 41, the spherical surface 411 of which abuts on the plate 3 of the moving brake friction member 30 in the loading point Y. The plate 3 is moved from its released position to braking position, in which the plate 3 abuts, by its rear end, in the stop point X, against the stop 6 and abuts, by its braking surface 31, against the cylinder 50 of the stationary brake friction member 5 at the contact abscissa 301, as depicted in the FIG. 1 through 4. With the embodiment according to the FIG. 5, the plate 3 abuts on the plane braking surface 52 of the cylinder 5 of the stationary brake friction member at the contact surface 302. At the moment of abutment, the plate 3 clamps the yarn 100 and, throughout drawing-off of the yarn 100, the plate 3 exerts the braking force on it. The braking force is possible to be regulated by change of pressure force of the control member's 4 action member, for the depicted embodiments, by air pressure on the pushing side of the pneumatic cylinder 40.

As schematically depicted in the FIG. 3, resulting force ratios in the braking point are determined by ratio of distance A from the braking point, formed by the contact abscissa 301, to the loading point Y, and distance B from the loading point Y to the stop point X.

Possible exchange of position of the control member 4 and the stop 6, ergo position of the loading point Y and the stop point X, does not influence the above described functionality of the device.

Protection of the device according to the invention is not limited by the described and depicted embodiment. Within range of the claims, the device can be variously modified according to specific needs and demands of the user.

The invention claimed is:

1. A method for braking of yarn at a renewal of spinning at a work position of a textile spinning machine, comprising:

with a vacuum tube of an attending device having a vacuum tube, sucking in an end of the yarn;

at drawing off of the yarn from the vacuum tube, braking the yarn between a braking surface of a stationary brake friction member and a moving brake friction member arranged on the attending device along a path of the yarn, wherein the moving brake friction member moves towards and into contact with a contact abscissa or surface of the stationary brake friction member;

applying an action force on the moving brake friction member at a loading point (Y) and a reaction force at a stop point (X);

wherein a first one of the loading point (Y) or the stop point (X) is located at an end of the moving brake friction member lying opposite to the contact abscissa or surface and the other respective point lies between the end of the moving brake friction member and the first point;

wherein the action force is generated by a control member acting on the moving brake friction member at the loading point (Y), and the reaction force is generated by a stop against which the moving brake friction member contacts at the stop point (X); and wherein the braking surface of the moving brake friction member abuts against the braking surface of the stationary brake friction member along an entire longitudinal length of the contact abscissa or surface.

2. The method as in claim 1, wherein the loading point (Y) lies between the contact abscissa or surface and the stop point (X).

3. The method as in claim 1, wherein the stop point (X) lies between the contact abscissa or surface and the loading point (Y).

4. The method as in claim 1, wherein a connecting line between the loading point (Y) and the stop point (X) divides the contact abscissa or surface essentially into half.

5. The method as in claim 1, comprising moving the stationary brake friction member and the moving brake friction member to an unbraked position outside of an operative area for yarn braking prior to commencement of yarn braking.

6. The method as in claim 1, wherein the action force is generated by a pneumatic cylinder of the control member.

7. The method as in claim 6, comprising adjusting the action force by changing air pressure acting on the pneumatic cylinder.

8. A device for braking yarn at a renewal of spinning at a work position of a textile spinning machine, comprising:

an attending device arranged displaceably along a plurality of the work positions, the attending device having a vacuum tube for sucking in and subsequent release of an end of the yarn for spinning-in;

a stationary brake friction member and a moving brake friction member configured adjacent to a mouth of the vacuum tube;

the stationary brake friction member comprising a braking surface arranged across a path of the yarn;

the moving brake friction member arranged under the stationary brake friction member and movable between a released position and a braking position wherein an end of the moving brake friction member moves into contact with a contact abscissa or surface of the stationary brake friction member;

a control member disposed to provide an action force on the moving brake friction member at a loading point (Y);

a stop disposed so as to generate a reaction force on the moving brake friction member at a stop point (X); and wherein a first one of the loading point (Y) or the stop point (X) is located at an end of the moving brake friction member lying opposite to the contact abscissa or surface and the other respective point lies between the end of the moving brake friction member and the first point.

9. The device as in claim 8, wherein the control member is disposed to abut against the moving brake friction member between the contact abscissa or surface and the stop.

10. The device as in claim 8, wherein the control member is disposed to abut against an end of the moving brake friction member opposite to the contact abscissa or surface.

11. The device as in claim 8, wherein the control member comprises a pneumatic cylinder for generating the action force on the moving brake friction member.

12. The device as in claim 11, wherein the control member further comprises an air pressure regulator configured to vary the braking force applied by the moving brake friction member.

13. The device as in claim 8, wherein at least one of a contact point between the control member and the moving brake friction member, or between the moving brake friction member and the stop is a spherical contact.

14. The device as in claim 8, wherein the stationary brake friction member comprises a cylinder, the cylinder defining a contact abscissa against which the moving brake friction member acts.

15. The device as in claim 8, wherein the stationary brake friction members comprises a planar braking surface, the planar braking surface defining a contact surface against which the moving brake friction member acts.

* * * * *